US005853662A

United States Patent [19]

Watanabe

[11] Patent Number: 5,853,662

[45] **Date of Patent: *Dec. 29, 1998**

[54] METHOD FOR PRESERVING POLISHED INORGANIC GLASS AND METHOD FOR PRESERVING ARTICLE OBTAINED BY USING THE SAME

[75] Inventor: Takayuki Watanabe, Tokyo, Japan

[73] Assignee: Mitsubishi Gas Chemical Company, Inc., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 634,061

[22] Filed: Apr. 17, 1996

[51] Int. Cl.[6] ..... B01J 19/00

[52] U.S. Cl. ..... 422/40; 252/387; 252/397; 422/1

[58] Field of Search ..... 422/1, 40; 252/387, 252/397

[56] References Cited

U.S. PATENT DOCUMENTS

| | | | |
|---|---|---|---|
| 4,277,523 | 7/1981 | Izumitani et al. | 422/40 X |
| 5,219,524 | 6/1993 | Evans, II | 422/40 |
| 5,260,023 | 11/1993 | Evans, II | 422/40 |
| 5,286,407 | 2/1994 | Inoue et al. | 252/188 |
| 5,305,948 | 4/1994 | Yoshikawa et al. | 228/205 |
| 5,378,428 | 1/1995 | Inoue et al. | 422/9 |
| 5,415,907 | 5/1995 | Inoue et al. | 428/36.2 |
| 5,525,296 | 6/1996 | Hollinger, Jr. | 422/40 |

*Primary Examiner*—Krisanne Thornton
*Attorney, Agent, or Firm*—Armstrong, Westerman, Hattori, McLeland & Naughton

[57] ABSTRACT

Disclosed is a method for preserving a polished inorganic glass or an article obtained by using the same by enclosing the polished inorganic glass or the article obtained by using the same in a container having a gas barrier property, and then, sealing the container to remove substantially both oxygen and moisture from the container.

22 Claims, No Drawings

METHOD FOR PRESERVING POLISHED INORGANIC GLASS AND METHOD FOR PRESERVING ARTICLE OBTAINED BY USING THE SAME

BACKGROUND OF THE INVENTION

1) Field of the Invention

The present invention relates to a method for preserving a polished inorganic glass and a method for preserving an article which has been obtained by using the same (hereinafter, referred to as "an article obtained by using the same"), and more particularly to a method for preserving which comprises enclosing a polished inorganic glass (or an article obtained by using the same) together with an oxygen absorbent and a drying agent in a container having a gas barrier property and then sealing the container.

2) Prior Art

In master boards of optical disk, generally, blue sheet glass to which sodium carbonate obtainable at a low production cost has been added, is used as the glass substrate. It is known that, in a glass substrate obtained by surface-polishing a blue sheet glass, alkali metal ions such as sodium ion contained in the glass, etc., are diffused to the surface of the glass substrate and react with substances in the atmosphere, often resulting in whitish clouding (hereinafter, referred to as "weathering"), and particularly, a marked "weathering" is generated after surface-polishing. The more thoroughly the glass is polished, i.e., the smoother glass surface, the more readily the "weathering" is generated due to moisture locally adhering to minute polish scratches on the glass surface, so that the "weathering" becomes more remarkable since a mirror is formed on the glass surface. Although the "weathering" phenomenon occurs also in non-polished window glasses or glasses having a a rough surface, cases where marked "weathering" is generated to the extent of causing problems are rare. Therefore, in conventional glasses, "weathering" is not so important.

When a master board of optical disk is formed, in the first step a silane coupling agent layer is formed on a surface-polished glass substrate surface and then a posi-type resist containing a phenol novolak resin as its main component is coated thereon. In the next step, bits are drawn on the photoresist with an Ar ion laser beam, etc., and then non-electrolytic plating or vapor deposition is conducted after development of the resist, whereby a so-called glass master (master board of the optical disk) is formed. A metal master is prepared from the glass master. The metal master is installed in a mold for the disk of an injection molder used as a stamper for the production of plastic substrates of CD-ROM and the like.

However, in the above-mentioned formation of the glass master, when the "weathering" occurs on a surface-polished glass substrate, the photoresist layer is locally raised up from the glass substrate, so that defects occur causing failure of adhesion between the photoresist layer and the glass substrate, and the glass master thus obtained is not satisfactory. After all, the "weathering" of the glass substrate has become an important problem in the production of plastic substrates for CD-ROM and the like.

Moreover, recently, in optical glasses, arts for improving the refractive index thereof or strength thereof by adding various metals to an inorganic glass have been practically applied. However, also in the field of optical glass, weathering phenomena including "clouding", "staining", "dimming", etc., due to quality change of glass sometimes occur. Also in this case, it is known that the such phenomena readily occur particularly after the polishing step.

For example, when a glass wherein refractive index has been increased by adding PbO is preserved for a long time even at room temperature or exposed under severe circumstances of a high temperature and high humidity during transportation, etc., even for a short time, substances added to a glass are selectively dissolved from the glass surface due to dew condensation on the glass surface, so that "clouding" is generated on the glass surface or interference color appears due to formation of a layer having a refractive index different from that of the glass, resulting in so-called "staining". Further, when moisture evaporates after ingredients which have been dissolved have formed some deposits on the glass, "staining" which is deposited as white spotted particles on the glass surface results. In a severe case in lead silicate glasses, Pb on the glass surface is dissolved forming a $SiO_2$ rich layer having a low refractive index, resulting in marked "staining". In barium borate glasses, Ba and B are dissolved forming a $SiO_2$ rich brittle glass. Thus, when phenomena including "clouding", "dimming" and "staining" occur in optical glasses made using polished inorganic glasses, they are unsuitable for optical uses including lenses, etc.

As described above, troublesome phenomena due to quality change of polished inorganic glasses, including "weathering" in a glass substrate, "clouding", "dimming" and "staining" in an optical glass, etc., hereinafter, are referred to as "weathering".

Although in the preservation of polished inorganic glasses including glass substrates, optical glasses, etc., usually drying agents such as silica gel and the like are used, quality change of glass cannot be prevented by the drying agents and still "weathering" on the glass surface is generated, so that the drying agents do not often provide sufficient function. Thus, in the preservation of polished inorganic glass, no method capable of preventing "weathering" and preserving compactly and easily has yet been found.

SUMMARY OF THE INVENTION

An object of the present invention, in order to solve above-mentioned problems, is to provide a method for preserving a polished inorganic glass or an article obtained by using the same wherein quality change of glass is prevented during preservation and "weathering" is not generated.

As a result of an extensive study for solving the above-mentioned prior art problems, the present inventors have found that it is necessary to remove both oxygen and moisture during preservation of a polished inorganic glass or an article obtained by using the same in order to solve the above-mentioned prior art problems and the above-mentioned object can be attained by enclosing a polished inorganic glass or an article obtained by using the same together with an oxygen absorbent and a drying agent in a container having a gas barrier property and then sealing the container, and established the present invention.

The present invention provides a method for preserving a polished inorganic glass which comprises:

enclosing a polished inorganic glass in a container having a gas barrier property, and then, sealing the container to remove substantially both oxygen and moisture from the container.

The present invention also provides a method for preserving an article obtained by using a polished inorganic glass which comprises:

enclosing the article obtained by using a polished inorganic glass in a container having a gas barrier property, and then, sealing the container to remove substantially both oxygen and moisture from the container.

Furthermore, the above-mentioned methods according to the present invention have the following preferable embodiments.

That is, in the methods for preserving according to the present invention, a polished inorganic glass or an article obtained by using the same is enclosed together with an oxygen absorbent requiring no moisture for absorption of oxygen and a drying agent.

In the methods for preserving according to the present invention, a polished inorganic glass or an article obtained by using the same is enclosed together with an oxygen absorbent requiring no moisture for absorption of oxygen, a drying agent and an acidic gas absorbent.

In the methods for preserving according to the present invention, the oxygen absorbent contains at least one compound selected from the group consisting of unsaturated fatty acid compounds, linear hydrocarbon polymers having an unsaturated group(s) and thermoplastic polymers as main ingredient and a substance to promote oxygen absorption.

In the methods for preserving according to the present invention, the interior of the container is maintained at an oxygen concentration of 5% or below and a relative humidity of 10% or below.

In the methods for preserving according to the present invention, the oxygen absorbent, the drying agent, or a mixture of the oxygen absorbent and the drying agent is covered with a gas-permeable packing material to form a parcel, and more preferably the parcel is further covered with a material releasing no dust to form a double-packed parcel.

In the method for preserving a polished inorganic glass, the polished inorganic glass is a glass substrate or an optical glass.

In the method for preserving an article obtained by using a polished inorganic glass, the article is composed of an optical glass, more preferably a master board of an optical disk or an optical disk substrate.

Further, In the method for preserving an article obtained by using a polished inorganic glass, the article is an optical instrument, more preferably one member selected from the group consisting of cameras, microscopes, telescopes, copying machines and laser printers.

DETAILED DESCRIPTION OF THE INVENTION

The present invention will be described in detail below.

The method according to the present invention (hereinafter, referred to as "the present method") is applied to a polished inorganic glass or an article obtained by using the same. Furthermore, the present method can be applied also to any glass shape, any raw material of glass and any glass product without limiting the range of use thereof, and the present method is suitable for the preservation of a glass substrate or an optical glass and an article obtained by using the same.

The polished inorganic glass of the present invention means a glass being obtained by polishing an inorganic glass having a refractive index ($n_d$) of 1.45 to 1.95 or an Abbe's number($\nu_d$) of 20 to 100.

Although surface roughness of inorganic glass after polishing applicable to the use of the present invention is not limited, it is preferable that the surface of the glass substrate or an optical glass not be too rough. Therefore, it is preferred that the average roughness (Ra) be 5 nm or below.

Examples of the glass substrate of the present invention include glasses for substrate including glasses for optical disk substrates, glasses for optical magnetic disk substrates, glasses for magnetic disk substrates, etc., master glasses including master glasses for optical disks, master glasses for optical magnetic disks, master glasses for magnetic disks, etc., glass substrates for LCDs including glass substrates for active matrix type LCDs, glass substrates for LCDs of clocks and watches, glass substrates for LCD of electronic calculators, glass substrates for LCD of cameras, etc., glass substrates for photo-masks including glass substrates for displays of solar cell, etc., glass substrates for photo-masks including glass substrates for LSI photo-masks, etc., image sensor cover glasses of solid photographing elements including color filters for liquid crystals, CCD, etc., window glasses for emission or light receiving elements, etc.

As inorganic glasses for the glass substrate of the present invention, glasses having a refractive index of about 1.5, generally blue sheet glasses to which sodium carbonate has been added, are used.

Examples of the optical glass of the present invention include lenses being used in optical instruments including cameras, microscopes, telescopes, copying machines, laser printers, etc., optical glass parts including optical glass parts for optical flats and cube corner reflectors, optical parts for laser reflecting mirrors, optical parts for interferometers, optical glass parts for cavities for ring laser gyros, etc.

The present method is suitable to the preservation of articles of optical glass and optical instruments obtained by using the above-mentioned optical glasses.

The optical glass used herein means an inorganic glass having a refractive index of 1.45 to 1.95 or an Abbe's number($\nu_d$) of 20 to 100.

Examples of the optical glass include ($SiO_2$—PbO—$R_2O$ (R=Na and/or K)) glasses and glasses further containing $B_2O_3$ or $Sb_2O_3$ in the same, ($SiO_2$—$B_2O_3$—$R_2O$—BaO (R=Na and/or K)) glasses and glasses further containing PbO or $TiO_2$ in the same, ($SiO_2$—$B_2O_3$—BaO) glasses and glasses further containing PbO or $TiO_2$ in the same, ($B_2O_3$—$La_2O_3$) glasses and conventional dispersion glasses further containing $ZrO_2$, $Y_2O_3$, $NbO_3$ and $WO_3$ in the same, and abnormal dispersion glasses including phosphate glasses, fluoride phosphate glasses, ($SiO_2$—$TiO_2$—$R_2O$—F (R=Na and/or K)) glasses, ($B_2O_3$—PbO) glasses and the like.

In the present method, it is necessary to enclose the above-mentioned polished inorganic glass or an article obtained by using the same in a container having a gas barrier property, and then seal the container to remove substantially both oxygen and moisture from the container. It is insufficient if only either oxygen or moisture is removed. It is essential to form an atmosphere wherein oxygen and moisture are not substantially present by removing both simultaneously. When either oxygen concentration or relative humidity is high, oxidation progresses causing "weathering" on the glass surface.

The term "remove oxygen substantially from the container" used herein means to maintain an oxygen concentration in the container of 5% or below, preferably 1% or below and more preferably 0.1% or below. Further, the term "remove moisture substantially from the container" used herein means to maintain a relative humidity in the container of 10% or below, preferably 5% or below, and more preferably 1% or below.

It is required that the oxygen absorbent of the present invention be capable of absorbing oxygen under dry conditions. Examples of the oxygen absorbent include known oxygen absorbents composed of metals and metal salts including, typically, sulfites, iron powders and iron salts, catechols, ascorbic acid etc., as the main ingredient.

An oxygen absorbent requiring no moisture for absorption of oxygen is preferably used. Particularly, oxygen absorbents containing at least one compound selected from the group consisting of unsaturated fatty acid compounds and linear hydrocarbon polymers having an unsaturated group(s) as the main ingredient and a substance to promote oxygen absorption are more preferably used.

The oxygen absorbent of the present invention comprises at least one compound selected from the group consisting of unsaturated fatty acid compounds, linear hydrocarbon polymers having an unsaturated group(s) and thermpoplastic polymers as the main ingredient, a substance to promote oxygen absorption and a carrier substance and preferably further contains an acidic gas absorbent.

The unsaturated fatty acid compound being used herein is an unsaturated fatty acid having at least 10 carbon atoms and at least one carbon-carbon double bond and/or a salt or ester thereof. The unsaturated fatty acids, salts and esters thereof may optionally contain a substituted group(s), e.g., hydroxyl group, formyl group, etc. The unsaturated fatty acid compound is not necessarily a pure substance.

Examples of the unsaturated fatty acid compound include unsaturated fatty acids such as oleic acid, linoleic acid, linolenic acid, arachidonic acid, parinaric acid, dimer acid, ricinoleic acid, etc., esters thereof, fats and oils containing esters thereof and metal salts thereof.

As the unsaturated fatty acid of the present invention, fatty acids obtained from vegetable oils and animal oils, i.e., linseed oil fatty acid, soybean oil fatty acid, tung oil fatty acid, rice bran oil fatty acid, sesame oil fatty acid, cotton seed oil fatty acid, rapeseed oil fatty acid, tall oil fatty acid, and the like are usable in the present invention.

The linear hydrocarbon polymer having an unsaturated group(s) of the present invention means a polymer having at least 10 carbon atoms and at least on carbon-carbon double bond and derivatives thereof. The derivatives may optionally contain substituted groups including hydroxyl group(s), amino group(s), formyl group(s), carboxyl group(s), etc.

Examples of the linear hydrocarbon compound having an unsaturated group(s) of the present invention include oligomers or polymer of butadiene, isoprene, 1,3-pentadiene etc. The linear hydrocarbon compound having an unsaturated group(s) is not necessarily a pure substance, and may be contain a small amount of impurities within the ordinary range such as residue of a solvent mixed in during production.

Examples of the thermoplastic polymers of the present invention include polyamides, polyolefins, etc.

Examples of the substance to promote oxygen absorption of the present invention include metal salts to promote oxidation of organic compounds and radical initiators. As the metal salts, transition metal salts such as those of Cu, Fe, Co, Ni, Cr, Mn, etc., are preferably used. As the transition metal salts, for example, transition metal salts of unsaturated fatty acids are preferably used.

Examples of the carrier substance of the present invention include paper or synthetic paper formed of natural pulp or synthetic pulp, silica gel, alumina, activated carbon, zeolite, pearlite, activated clay, etc. Particularly, when the main ingredient is a liquid substance, it is preferred that the liquid substance in the oxygen absorbent be supported on an adsorbing substance. Further, it is often more practical also to select a carrier substance that has also been selected as the drying agent and maintain the carrier drying function.

Examples of the drying agent used in the present invention include paper or synthetic paper formed of natural pulp or synthetic pulp, silica gel, alumina, activated carbon, zeolite, pearlite, activated clay, calcium oxide, barium oxide, calcium chloride, barium bromide, calcium hydride, calcium sulfate, magnesium chloride, magnesium oxide, magnesium sulfate, aluminum sulfate, sodium sulfate, sodium carbonate, potassium carbonate, zinc chloride, etc.

In the present invention it is preferable to use an acidic gas absorbent together with the drying agent.

The acidic gas absorbent of the present invention may be a substance capable of absorbing or adsorbing acidic substances being produced by reaction of the main component and oxygen or acidic substances introduced in to the preserving atmosphere. For example, oxides, hydroxides, carbonates and organic acid salts of alkali metals or alkaline earth metals and organic amines are usable. Further, it is possible also to select an acidic gas absorbent as the above-mentioned carrier substance or drying agent and have the acidic gas absorbent maintain the above-mentioned carrier function and/or drying function. In such case, further acidic gas absorbent need not be added.

Each component in the oxygen absorbent is used in the following proportions. That is, per 100 parts by weight of a main ingredient, the amount of the substance used to promote oxygen absorption is in the range of 0.01 to 40 parts by weight; that of the carrier substance is in the range of 1 to 1,000 parts by weight; that of the drying agent is in the range of 1 to 1,000 parts by weight and that of the acid gas absorbent is in the range of 0 to 1,000 parts by weight.

In the present invention, the oxygen absorbent, the drying agent and the acidic gas absorbent can be used in a mixture. The mixture is changed into a form of powders, granules, tablets, etc., to use as a composition.

It is not preferable to permit direct contact between the oxygen absorbent, the drying agent and the acidic gas absorbent with the article to be preserved. They are usually used as a parcel covered with a gas permeable packing material. A portion or all of the drying agent and the acidic gas absorbent may be used together with the oxygen absorbent in one parcel or in separate parcels.

The form of the parcel of the present invention is not limited and may optionally have the form, of e.g., small bag, sheet, blister parcel, etc. Packing materials and structures of the parcel are not limited. For example, the above-mentioned composition is filled into a small bag laminated with a porous plastic film in which paper of non-woven fabric has been used as a substrate and then the small bag is heat-sealed to form a parcel.

Since the polished inorganic glass is used for optics, it is unpreferable for dust or foreign substances to adhere thereon. It is preferable to conduct dust proofing treatment on the parcel. As a dust proofing treatment, it is effective to cover the parcel with a material that does not hinder the permeation of either oxygen or moisture and releases no dust generated from the parcel into exterior, thus forming a double-packed parcel. However, when the dust proofing treatment has been conducted for the parcel itself, the parcel need not be further covered with a dust proof material.

It is preferred that the container having a gas barrier property of the present invention has an oxygen permeability of 10 $ml/m^2$•Day•atm or below at 25° C. at a relative humidity (hereinafter, referred to as "RH") of 60% and a water vapor permeability of 1 $g/m^2$•Day or below at 40° C. at 90% RH.

The container having a gas barrier property of the present invention is selected depending upon the article to be preserved and may be a plastic container, a film bag or metallic container, formed of a material having a gas barrier property. It is advantageous in cost to select the gas barrier performance depending upon the intended preservation time and the object to be preserved so as not to provide excess performance.

PREFERRED EMBODIMENTS OF THE INVENTION

Some of the preferred embiments of the present invention will be described in detail below, referring to Examples, which are not intended to limit the scope of the present invention.

EXAMPLE 1

The gas absorbent parcel used in Example 1 was prepared as follows.

3.5 g of zeolite and a mixture of 1 g of soybean oil with 0.2 g of cobalt naphthenate were mixed with a blender. The resultant mixture was allowed to stand at 25° C. for 10 minutes to obtain a granular composition. A mixture of 5 g of the thus obtained granular composition with 2.5 g of calcium oxide was filled into a small bag formed of paper (size; 5 cm×7.5 cm), laminated with porous polyethylene film on its interior side and then the opened portion of the small bag was heat sealed, thus preparing an oxygen absorbent parcel.

A disk (130 mmϕ outer diameter and 1.2 mm thickness) of soda lime glass having a refractive index of 1.51 was precisely surface-polished with a polishing agent containing cerium oxide, made by BUEHLER LTD., trademark Miromet, using a precise polishing machine, made by SHICAYAMA KIKAI INTL, LTD., Japan, trademark Lapmaster 15 so as to have an average roughness (Ra) of 5 nm or below, whereby a glass master board for CD-ROM was obtained. The average roughness (Ra) was measured by a SURFCOM 550 A trademark, made by K.K. TOKYO SEIMITU CO., LTD., Japan.

Then, both the thus obtained glass for the master board of the CD-ROM and the above-mentioned oxygen absorbent were enclosed together with 500 ml of air at 25° C. and at 60% RH in a packing bag formed of an aluminum foil laminate (stretched polypropylene/aluminum foil/polyethylene); size 220 mm×300 mm (hereinafter, referred to as "Al bag") and then the opened portion of the Al bag was heat sealed to seal hermetically. The hermetically sealed Al bag was preserved for 30 days under an atmosphere of 85° C. and and 85% RH.

After preserving for 30 days, both the oxygen concentration and moisture concentration in the sealed Al bag were determined by gas chromatography. It was found that neither oxygen nor moisture were substantially present in the interior of the sealed Al bag. Then, the sealed Al bag was opened and the glass for the master board of CD-ROM was taken out. Breath was blown upon the surface of the glass for the master board of the CD-ROM thus taken out and then it was observed applying a light from a slide projector obliquely from a location lower than that of the glass while holding the glass to the light. No clouding was observed on the glass surface and the same state as in the initial stage was maintained.

The result of Example 1 is shown Table 1.

COMPARATIVE EXAMPLES 1 TO 3

The glass for the master board of the CD-ROM obtained in Example 1 was used. Only the glass for the master board of the CD-ROM in Comparative Example 1, both the glass for the master board of the CD-ROM and four parcels containing 2 g of trademark Fuji•Silicagel, A-type, made by FUJI-DAVISONCHEMICAL LTD., Japan in Comparative Example 2, and both the glass for the master board of the CD-ROM and one parcel of moisture-holding type iron powder oxygen absorbent, trademark Ageless Z-100 PK, made by Mitsubishi Gas Chemical Inc., Japan in Comparative Example 3, respectively were enclosed together with 500 ml of air at 25° C. and at 60% RH in Al bags and then all of the bags were hermetically sealed. The Al bags were preserved under an atmosphere of 85° C. and 85% RH for 30 days.

After 30 days, each Al bag was opened and then the glasses for the master board of the CD-ROM were taken out to be observed in the same manner as in Example 1. Whitish clouding was observed on the surfaces of all the glasses of master board of the CD-ROM in Comparative Examples 1 to 3.

The results of Comparative Examples 1 to 3 are shown in comparison with Example 1 in Table 1.

EXAMPLES 2 TO 6

In Examples 2 to 6, the oxygen absorbent parcels were prepared in the same manner as in Example 1 except that the combination between main ingredient and a substance to promote oxygen absorption in the oxygen absorbent of Example 1 was changed respectively as follows:

| | main ingredient (1 g) | substance to promote oxygen absorption (0.2 g) |
|---|---|---|
| Example 1 | soybean oil | cobalt naphthenate (**) |
| 2 | tall oil fatty acid | cobalt naphthenate (**) |
| 3 | soybean oil | cobalt salt of tall oil fatty acid (***) |
| 4 | soybean oil + liquid polyisoprene (*) | cobalt naphthenate (**) |
| 5 | soybean oil | cobalt stearate (****) |
| 6 | tall oil fatty acid | cobalt salt of tall oil fatty acid (***) |

Note:
(*) the mixture ratio of soybean oil : liquid polyisoprene (trademark Daiclean R113, made by Japan Synthetic Rubber Co., Japan) = 6:4 (ratio by weight)
(**) cobalt content: 8% by weight
(***) cobalt content: 6% by weight
(****) cobalt content: 8% by weight The preservation test for the glasses for the master board of the CD-ROM was conducted in the same manner as in Example 1, using the thus obtained gas absorbents. The results of the preservation test are shown in Table 2.

EXAMPLE 7

$SiO_2$, PbO, $H_3BO_3$, $Na_2CO_3$, $NaNO_3$, $KNO_3$ and $Sb_2O_3$ as starting materials filled in a platinum crucible were maintained in a molten state for 2 hours at about 1350°, thus forming a homogeneous molten glass. Then, the molten glass thus obtained was cast on a steel sheet of about 150° C. and then put in an electric furnace set to about 460° C. close to glass transition point in advance, and cooled to a room temperature over about 20 hours, whereby a transparent glass sheet was obtained. The thus obtained glass sheet was precisely surface-polished with a polishing agent made by BUEHLER LTD., trademark Miramet, using a precise polishing machine so as to have an average roughness (Ra) of 5 nm or below.

The components of the glass were 64.8% by weight (hereinafter, referred as to "wt. %") of $SiO_2$, 8 wt. % of PbO, 5 wt. % of $B_2O_3$, 15 wt. % of $Na_2O$, 7 wt. % of $K_2O$ and 0.2 wt. % of $Sb_2O_3$. The glass had a refractive index of 1.52.

Then, both the thus polished glass sheet and the above-mentioned oxygen absorbent were enclosed together with 500 ml of air at 25° C. and at 60% RH in a packing bag formed of an aluminum foil laminate (stretched polypropylene/aluminum foil/polyethylene); size 220 mm×300 mm (hereinafter, referred to as "Al bag") and then the opened portion of the Al bag was heat sealed to seal hermetically. The hermetically sealed Al bag was preserved for 30 days under an atmosphere of 85° C. and 85% RH.

After preserving for 30 days, both the oxygen concentration and moisture concentration in the sealed Al bag were determined by gas chromatography. It was found that neither oxygen nor moisture were substantially present in the interior of the sealed Al bag. Then, the sealed Al bag was opened and the glass sheet was taken out. Breath was blown upon the surface of the glass sheet thus taken out and then it was observed by applying a light from a slide projector obliquely from a location lower than that of the glass while holding the glass to the light. No clouding was observed on the glass surface and the same state as in initial stage was maintained.

The result of Example 7 is shown Table 3.

COMPARATIVE EXAMPLES 4 TO 6

The polished glass sheet obtained in Example 7 was used. Only the polished glass sheet in Comparative Example 4, both the polished glass sheet and four parcels containing 2 g of trademark Fuji•Silicagel, A-type, made by FUJI-DAVISONCHEMICAL LTD., Japan in Comparative Example 5 and both the polished glass sheet and one parcel of moisture-holding type iron powder oxygen absorbent, trademark Ageless Z-100 PK, made by Mitsubishi Gas Chemical Inc., Japan in Comparative Example 6, respectively, were enclosed together with 500 ml of air at 25° C. and at 60% RH in an Al bag and then all of the bags were hermetically sealed. The Al bags were preserved under an atmosphere of 85° C. and 85% RH for 30 days.

After 30 days, each Al bag was opened and then the polished glass sheets were taken out to observe in the same manner as in Example 1. Spotted clouding was observed on the glass surface of Comparative Example 4. Slight clouding was observed on each glass surface of Comparative Example 5 to 6.

The results of Comparative Examples 4 to 6 are shown in comparison with Example 7 in Table 3.

According to the present invention when a polished inorganic glass or an article obtained by using the same is enclosed in a container having a gas barrier and then the container is sealed to preserve, quality change of glass can be prevented and good preservation can be secured without generating "dimming" on a glass surface.

The present method is particularly suitable to preservation of a polished glass substrate, an optical glass and an article obtained by using the same.

Particularly, according to the present method, when a polished inorganic glass or an article obtained by using the same is enclosed together with an oxygen absorbent, preferably an oxygen absorbent containing at least one compound selected from the group consisting of unsaturated fatty acid compounds, linear hydrocarbon polymers having an unsaturated group(s) and thermoplastic resins as main ingredient and a substance to promote oxygen absorption, and a drying agent in a container having a gas barrier property and then the container is sealed, the polished inorganic glass or an article obtained by using the same can be favorably preserved according to a very simple and easy method.

TABLE 1

| Item | Example 1 | Comp. Ex. 1 | Comp. Ex. 2 | Comp. Ex. 3 |
|---|---|---|---|---|
| Treatment in interior of preservation bag | Gas absorbent of the present invention enclosed | Non-treated | Drying agent enclosed | Moisture-holding type iron powder oxygen absorbent enclosed |
| Interior of bag after 30 days | | | | |
| Oxygen concentration (%) | 0.06 | 20.8 | 20.8 | 0.2 |
| Humidity (% RH) | 0.8 | 72 | 5 | 76 |
| State of surface of glass master board for CD-ROM | No clouding was observed The same state as in initial stage | Whitish clouding was observed | Slight whitish clouding was observed | Slight whitish clouding was observed |

TABLE 2

| Item | Example 2 | Example 3 | Example 4 | Example 5 | Example 6 |
|---|---|---|---|---|---|
| Organic compound as main ingredient | Tall oil fatty acid | Soybean oil | Soybean oil + liquid polyisoprene | Soybean oil | Tall oil fatty acid |
| Substance to promote oxygen absorption | Cobalt naphthenate | Cobalt salt of tall oil fatty acid | Cobalt naphthenate | Cobalt stearate | Cobalt salt of tall oil fatty acid |
| Interior of bag after 30 days | | | | | |
| Oxygen concentration (%) | 0.07 | 0.06 | 0.05 | 0.07 | 0.05 |
| Humidity (% RH) | 0.7 | 0.8 | 0.8 | 0.8 | 0.7 |
| State of surface of glass master board for CD-ROM | No clouding was observed The same state as in initial stage | No clouding was observed The same state as in initial stage | No clouding was observed The same state as in initial stage | No clouding was observed The same state as in initial stage | No clouding was observed The same state as in initial stage |

TABLE 3

| Item | Example 7 | Comp. Ex. 4 | Comp. Ex. 5 | Comp. Ex. 6 |
|---|---|---|---|---|
| Treatment in interior of preserving bag | Gas absorbent of the present invention enclosed | Non-treated | Drying agent enclosed | Moisture-holding type iron powder oxygen absorbent enclosed |
| Interior of bag after 30 days | | | | |
| Oxygen concentration (%) | 0.04 | 20.9 | 20.9 | 0.2 |
| Humidity (% RH) | 0.7 | 70 | 6 | 75 |
| State of surface of polished inorganic glass | No clouding was observed The same state as in initial stage | Spotted clouding was observed | Slight spotted clouding was observed | Slight spotted clouding was observed |

What is claimed is:

1. A compact and easy method for preserving a polished inorganic glass which comprises:

enclosing a polished inorganic glass in a container having a gas barrier property with an oxygen permeability of 10 ml/$^2$•Day•atm or below at 25° C. at 60% RH and a water vapor permeability of 1 g/m$^2$•Day or below at 40° C. at 90% RH together with an oxygen absorbent requiring no moisture for absorption of oxygen and a drying agent, and then, sealing the container to remove substantially both oxygen and moisture from the container, thereby preventing weathering of the polished glass.

2. The method for preserving according to claim 1, wherein the polished inorganic glass is enclosed together with an oxygen absorbent requiring no moisture for absorption of oxygen, a drying agent and an acidic gas absorbent.

3. The method for preserving according to claim 1, wherein the oxygen absorbent contains at least one compound selected from the group consisting of unsaturated fatty acid compounds, linear hydrocarbon polymers having an unsaturated group(s) and thermoplastic polymers as the main ingredient and a substance to promote oxygen absorption.

4. The method for preserving according to claim 1, wherein the interior of the container is maintained at an oxygen concentration of 5% or below and a relative humidity of 10% or below.

5. The method for preserving according to claim 3, wherein the oxygen absorbent further contains a carrier substance.

6. The method for preserving according to claim 1, wherein the oxygen absorbent, the drying agent, or a mixture of the oxygen absorbent and the drying agent is covered with a gas-permeable packing material to form a parcel.

7. The method for preserving according to claim 6, wherein the parcel is further covered with a material releasing no dust to form a double-packed parcel.

8. The method for preserving according to claim 1, wherein the polished inorganic glass is a glass substrate.

9. The method for preserving according to claim 1, wherein the polished inorganic glass is an optical glass.

10. A compact and easy method for preserving an article obtained by using a polished inorganic glass which comprises:

enclosing an article obtained by using a polished inorganic glass in a container having a gas barrier property with an oxygen permeability of 10 ml/m$^2$•Day•atm or below at 25° C. at 60% RH and a water vapor permeability of 1 g/m$^2$•Day or below at 40° C. at 90% RH together with an oxygen absorbent requiring no moisture for absorption of oxygen and a drying agent, and then, sealing the container to remove substantially both oxygen and moisture from the container, thereby preventing weathering of the polished glass.

11. The method for preserving according to claim 10, wherein the article obtained by using a polished inorganic glass is enclosed together with an oxygen absorbent requiring no moisture for absorption of oxygen, a drying agent and an acidic gas absorbent.

12. The method for preserving according to claim 10, wherein the oxygen absorbent contains at least one compound selected from the group consisting of unsaturated fatty acid compounds, linear hydrocarbon polymers having an unsaturated group(s) and thermoplastic polymers as the main ingredient and a substance to promote oxygen absorption.

13. The method for preserving according to claim 10, wherein the interior of the container is maintained at an oxygen concentration of 5% or below and a relative humidity of 10% or below.

14. The method for preserving according to claim 12, wherein the oxygen absorbent further contains a carrier substance.

15. The method for preserving according to claim 10, wherein the oxygen absorbent, the drying agent, or a mixture of the oxygen absorbent and the drying agent is covered with a gas-permeable packing material to form a parcel.

16. The method for preserving according to claim 15, wherein the parcel is further covered with a material releasing no dust to form a double-packed parcel.

17. The method for preserving according to claim 10, wherein the article obtained by using a polished inorganic glass is composed of an optical glass.

18. The method for preserving according to claim 10, wherein the article obtained by using a polished inorganic glass is composed of a glass substrate.

19. The method for preserving according to claim 18, wherein the glass substrate is a master board of an optical disk.

20. The method for preserving according to claim 18, wherein the glass substrate is an optical disk substrate.

21. The method for preserving according to claim 10, wherein the the article obtained by using a polished inorganic glass is an optical instrument.

22. The method for preserving according to claim 21, wherein the the optical instrument is one member selected from the group consisting of cameras, microscopes, telescopes, copying machines and laser printers.

* * * * *

UNITED STATES PATENT AND TRADEMARK OFFICE

CERTIFICATE OF CORRECTION

PATENT NO.: 5,853,662
DATED : December 29, 1998
INVENTOR(S): Takayuki WATANABE

It is certified that errors appear in the above-identified patent and that said Letters Patent is hereby corrected as shown below:

In column 11, in claim 1 on line 22, please change "10ml/$^2$ ·Day ·atm" to be --10ml/m$^2$ ·Day ·atm-- column 4, on lines 9 and 10, please change "LCD" to be --LCDs-- where it appears.

Signed and Sealed this

Twenty-sixth Day of October, 1999

*Attest:*

Q. TODD DICKINSON

*Attesting Officer*

*Acting Commissioner of Patents and Trademarks*